US011647831B2

(12) United States Patent
Pan

(10) Patent No.: US 11,647,831 B2
(45) **Date of Patent: *May 16, 2023**

(54) DESK FRAME ELEVATION STRUCTURE

(71) Applicant: Douglas Pan, Tainan (TW)

(72) Inventor: Douglas Pan, Tainan (TW)

( * ) Notice: Subject to any disclaimer, the term of this patent is extended or adjusted under 35 U.S.C. 154(b) by 91 days.

This patent is subject to a terminal disclaimer.

(21) Appl. No.: 17/381,480

(22) Filed: Jul. 21, 2021

(65) Prior Publication Data

US 2023/0028331 A1 Jan. 26, 2023

(51) Int. Cl.

| | |
|---|---|
| ***A47B 9/20*** | (2006.01) |
| ***A47B 9/10*** | (2006.01) |
| ***A47B 21/02*** | (2006.01) |
| ***A47B 17/02*** | (2006.01) |

(52) U.S. Cl.

CPC ..... *A47B 9/20* (2013.01); *A47B 9/10* (2013.01); *A47B 17/02* (2013.01); *A47B 21/02* (2013.01); *A47B 2200/0055* (2013.01); *A47B 2200/0059* (2013.01)

(58) Field of Classification Search

CPC ..... A47B 9/20; A47B 9/10; A47B 2200/0052; A47B 2200/0025; A47B 2200/0059; A47B 2200/002; A47B 2200/0051; A47B 2200/0055; A47B 2009/086; A47B 17/02; A47B 21/02

USPC ..... 248/404, 161, 188.2, 188.5; 108/147

See application file for complete search history.

(56) References Cited

U.S. PATENT DOCUMENTS

| | | | | | |
|---|---|---|---|---|---|
| 3,285,207 | A * | 11/1966 | Vom Hagen | A47C 3/285 | 108/150 |
| 3,521,341 | A * | 7/1970 | Hornlein | F16M 11/28 | 29/434 |
| 5,345,631 | A * | 9/1994 | Saperstein | A47C 19/024 | 5/509.1 |
| 6,378,816 | B1 * | 4/2002 | Pfister | F16C 29/04 | 248/161 |
| 6,615,744 | B1 * | 9/2003 | Eckstein | A47B 23/046 | 108/143 |
| 10,213,015 | B1 * | 2/2019 | Anderson | A47B 9/10 | |
| 10,226,119 | B1 * | 3/2019 | Ko | A47B 9/20 | |

(Continued)

FOREIGN PATENT DOCUMENTS

| | | | |
|---|---|---|---|
| CN | 108143098 | * | 6/2018 |
| CN | 108497727 | * | 9/2018 |

(Continued)

*Primary Examiner* — Janet M Wilkens

(74) *Attorney, Agent, or Firm* — Alan D. Kamrath; Karin L. Williams; Mayer & Williams PC

(57) ABSTRACT

A desk frame elevation structure includes an inner tube telescopically received in an outer tube and a roller unit between the inner and outer tubes. The outer tube is fixed to a base and includes a bottom plate and a first top plate. A desk board unit is fixed to the inner tube. A telescopic rod is received in the inner tube and has top and bottom ends coupled to the outer and inner tubes, respectively. The inner tube extends through an upper buffer pad disposed below the first top plate. The upper buffer pad has an upper face abutting the first top plate and a lower face for abutting an abutting edge of the inner tube. A lower buffer pad is disposed above the bottom plate and includes a lower face abutting the bottom plate and an upper face for abutting a bottom end of the inner tube.

7 Claims, 6 Drawing Sheets

(56) References Cited

U.S. PATENT DOCUMENTS

| | | | | |
|---|---|---|---|---|
| 10,342,327 | B2 * | 7/2019 | Lin | A47B 9/10 |
| 10,595,629 | B2 * | 3/2020 | Ko | F16C 29/048 |
| 10,871,187 | B2 * | 12/2020 | Walling | F16C 29/02 |
| 10,918,202 | B1 * | 2/2021 | Sie | A47B 9/06 |
| 11,497,304 | B1 * | 11/2022 | Pan | A47B 9/20 |
| 2019/0032691 | A1 * | 1/2019 | Lin | A47B 9/20 |
| 2019/0357668 | A1 * | 11/2019 | Knudtson | A47B 9/04 |
| 2020/0214439 | A1 * | 7/2020 | Bennett | A47B 9/20 |

FOREIGN PATENT DOCUMENTS

| | | | |
|---|---|---|---|
| CN | 109452758 | * | 3/2019 |
| DE | 202021104397 | * | 10/2021 |

* cited by examiner

DESK FRAME ELEVATION STRUCTURE

BACKGROUND OF THE INVENTION

The present invention relates to a desk frame elevation structure and, more particularly, to a structure for reducing movement noise and increasing stability during vertical movement of a desk board.

A typical desk generally includes a desk board disposed on top of a plurality of legs. However, the desk board with a fixed height has limited applications. Currently, a desk frame with an adjustable height is available. FIG. 6 shows a conventional desk frame including a base 1', an elevation unit 2', and a desk board 3'. A bottom portion of the elevation unit 2' is coupled to the base 1'. The desk board 3' is coupled to a top portion of the elevation unit 2'. The elevation unit 2' includes telescopic outer and inner tubes 21' and 22', a pneumatic rod 23', and a control device 24'. The outer tube 21' is disposed around the inner tube 22'. A bottom end of the outer tube 21' is coupled to the base 1'. A bottom plate 211' is mounted in the bottom end of the outer tube 21'. The outer tube 21' has an upper stop edge 212' at an upper end thereof. The inner tube 22' includes a top portion fixed to the desk board 3'. A stop block 221' is mounted to an outer periphery of a bottom portion of the inner tube 22'. The pneumatic rod 23' is disposed in the outer and inner tubes 21' and 22' and has a top end coupled to the inner tube 22' and a bottom end coupled to the bottom plate 211' of the outer tube 21'. The pneumatic rod 23' has a control end 231' at an upper portion thereof. The control device 24' is disposed on the control end 231' of the pneumatic rod 23'. When the control device 24' presses against the control end 231', the pneumatic rod 23' telescopes to adjust the height of the desk board 3'. When the control device 24' is released, the height of the desk board 3' is fixed.

The above structure supports the weight of the desk board 3' by the pneumatic rod 23' which also assists in elevation of the desk board 3'. When the desk board 3' is lifted, the stop block 221' abuts against the upper stop edge 212' to limit the height of the desk board 3'. However, when an operator operates in a wrong way causing the control device 24' to continuously press against the control end 231', the extending force of the pneumatic rod 23' causes rapid elevation of the desk board 3', resulting in larger impact noise caused by the stop block 221' and the upper stop edge 212' and larger shock of the desk board 3'. Furthermore, when the force applied by the operator on the control device 24' for pressing against the control end 231' causes an excessive downward pressing force on the desk board 3', a louder impact noise is generated at the bottom end of the inner tube 22' and the bottom plate 211' of the outer tube 21'.

Furthermore, since a gap exists between the outer and inner tubes 21' and 22' to allow vertical movement of the inner tube 22' in the outer tube 21', the inner tube 22' could deviate and cause friction between the outer periphery of the inner tube 22' and the outer tube 21', leading to wear to the outer periphery of the inner tube 22' as well as unsmooth movement and noise.

BRIEF SUMMARY OF THE INVENTION

An objective of the present invention is to provide a structure for reducing movement noise while increasing the stability of vertical movement of the desk board.

A desk frame elevation structure according to the present invention comprises a base unit, an elevation unit, a desk board unit, a movement control unit, and a shock absorbing unit. The base unit includes a base configured to be disposed on the ground. The elevation unit includes an elevation tube comprised of an outer tube and an inner tube. The inner tube is received in the outer tube and is telescopic relative to the outer tube. The outer tube includes a bottom end fixed to the base and includes an inner periphery and an outer periphery. A bottom plate is securely mounted to the bottom end of the outer tube. A first top plate is securely mounted to a top portion of the outer tube. The first top plate includes a central portion having a first through-hole through which the inner tube extends. The inner tube includes an inner periphery and an outer periphery. A second top plate is securely mounted to a top portion of the inner tube. The desk board unit is disposed on top of the elevation unit and coupled to the inner tube to move therewith. The movement control unit includes a telescopic rod having top and bottom ends and a control board. A control button is disposed on the top end of the telescopic rod. The telescopic rod is disposed in the elevation tube. The top and bottom ends of the telescopic rod are coupled to the outer tube and the inner tube, respectively. The control board is disposed in a position corresponding to the control button. The control board is operable to selectively press against or not press against the control button.

The shock absorbing unit includes a roller unit, an upper buffer pad, and a lower buffer pad. The roller unit includes a plurality of roller seats and a plurality of rollers. The plurality of roller seats is disposed on the outer periphery of the inner tube. A top face of an uppermost one of the plurality of roller seats forms an abutting edge. Each of the plurality of rollers is rotatably mounted on a respective one of the plurality of roller seats and is capable of rolling on the inner periphery of the outer tube. The upper buffer pad is made of soft material and is disposed below the first top plate of the outer tube. The upper buffer pad includes a central portion having a third through-hole through which the inner tube extends. The upper buffer pad further includes an upper face and a lower face. The upper face of the upper buffer pad abuts the first top plate. The lower face of the upper buffer pad abuts the abutting edge of the inner tube when the desk top unit is in the highest position. The lower buffer pad is made of soft material and is disposed above the bottom plate of the outer tube. The lower buffer pad includes an upper face and a lower face. The lower face of the lower buffer pad abuts the bottom plate. The upper face of the lower buffer pad abuts a bottom end of the inner tube when the desk top unit is in the lowest position.

By the desk frame elevation structure according to the present invention, the control board can be controlled to press against the control button to actuate the telescopic rod, thereby fixing the length of the telescopic rod and the height of the desk board unit. During the vertical movement of the desk board unit, the rollers of the roller unit roll on the inner periphery of the outer tube, preventing friction noise between the inner tube and the outer tube while improving the motion stability. When a user continuously uses the control board to press against the control button for keeping the telescopic rod in the extended state, the abutting edge of the roller unit abuts the lower face of the upper buffer pad. This further avoids large impact noise caused by the first top plate of the outer tube and the inner tube moving rapidly upward. This further avoids larger shock of the desk board unit, improving the motion stability.

When the control board is used to press against the control button, a force can be applied to press the desk board unit downward. When the desk board unit moves to the lowest position, the bottom end of the inner end abuts the upper face of the lower buffer pad, avoiding larger impact noise between the inner tube and the bottom plate of the outer tube. Furthermore, the desk board unit is prevented from larger shock to improve the motion stability and operational quality.

The present invention will become clearer in light of the following detailed description of illustrative embodiments of this invention described in connection with the drawings.

DETAILED DESCRIPTION OF THE INVENTION

Figure 1:
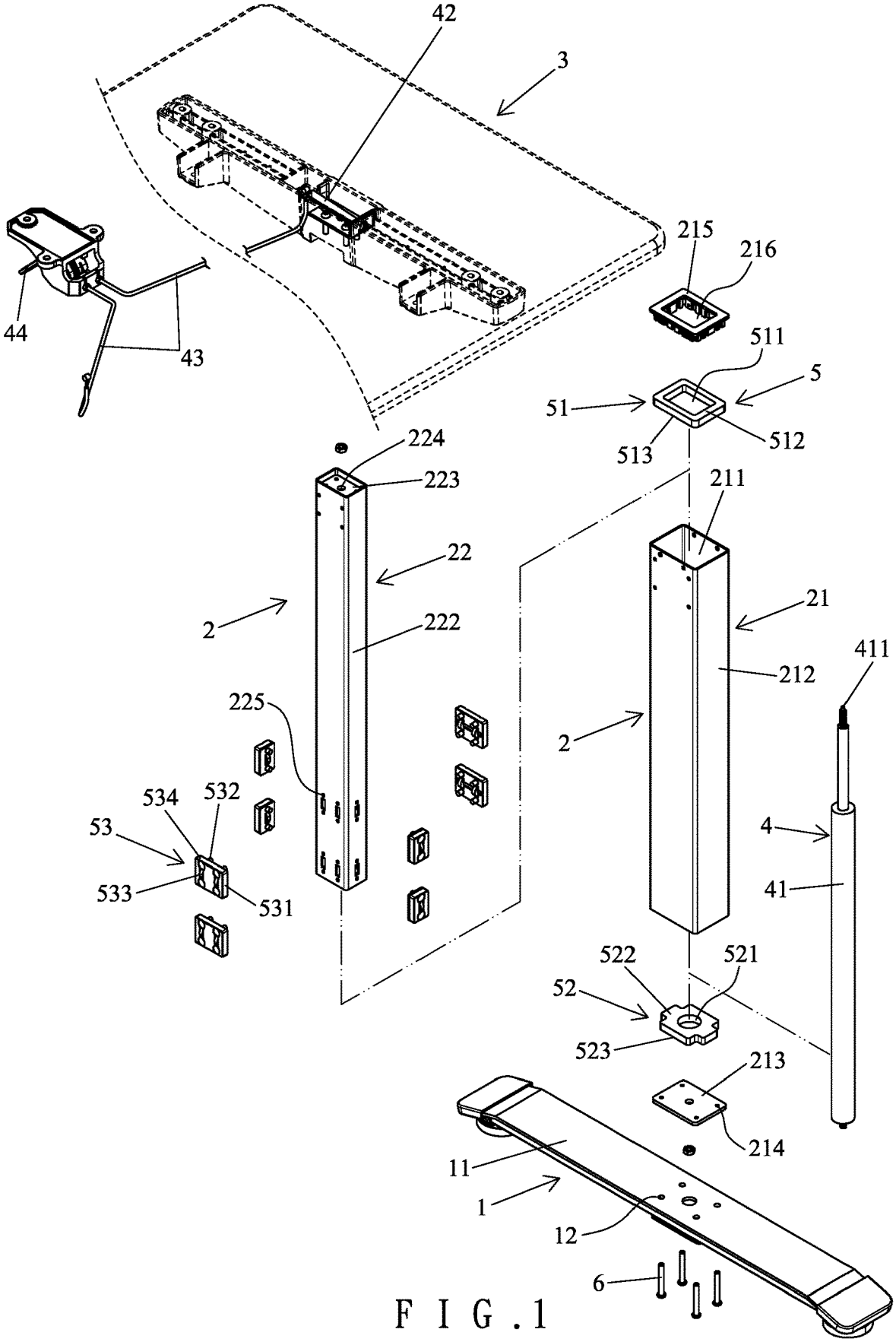
FIG. 1 is a partial, exploded, perspective view of a desk frame elevation structure of an embodiment according to the present invention.
Figure 2:
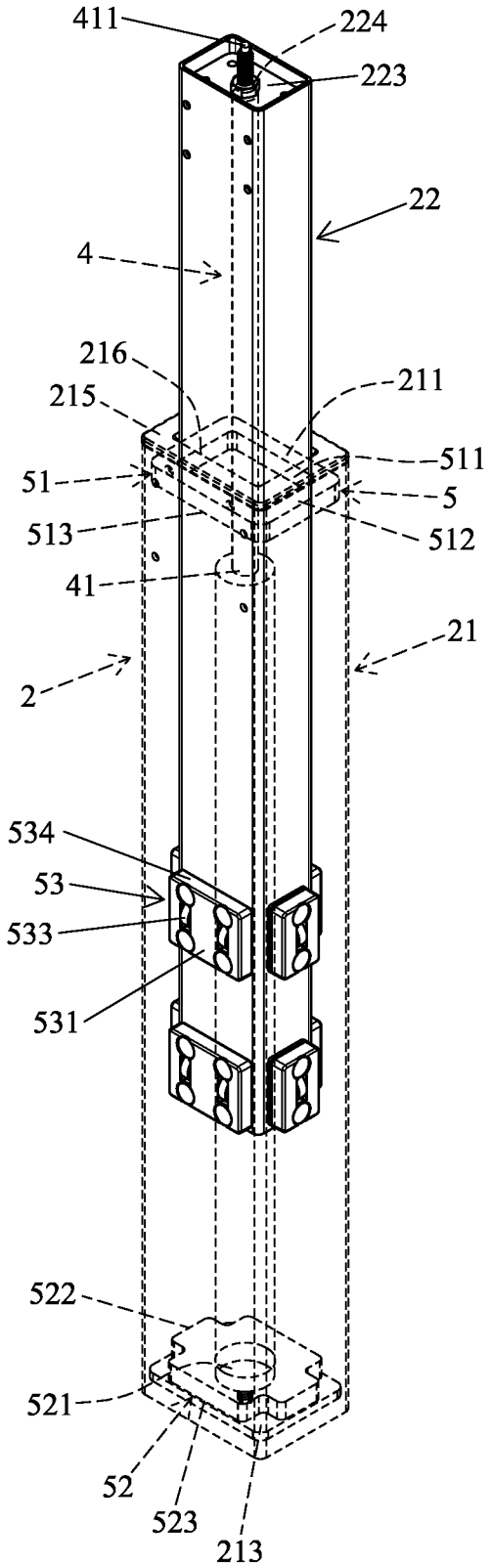
FIG. 2 is a perspective view of a portion of the desk frame elevation structure of the embodiment according to the present invention.
Figure 3:
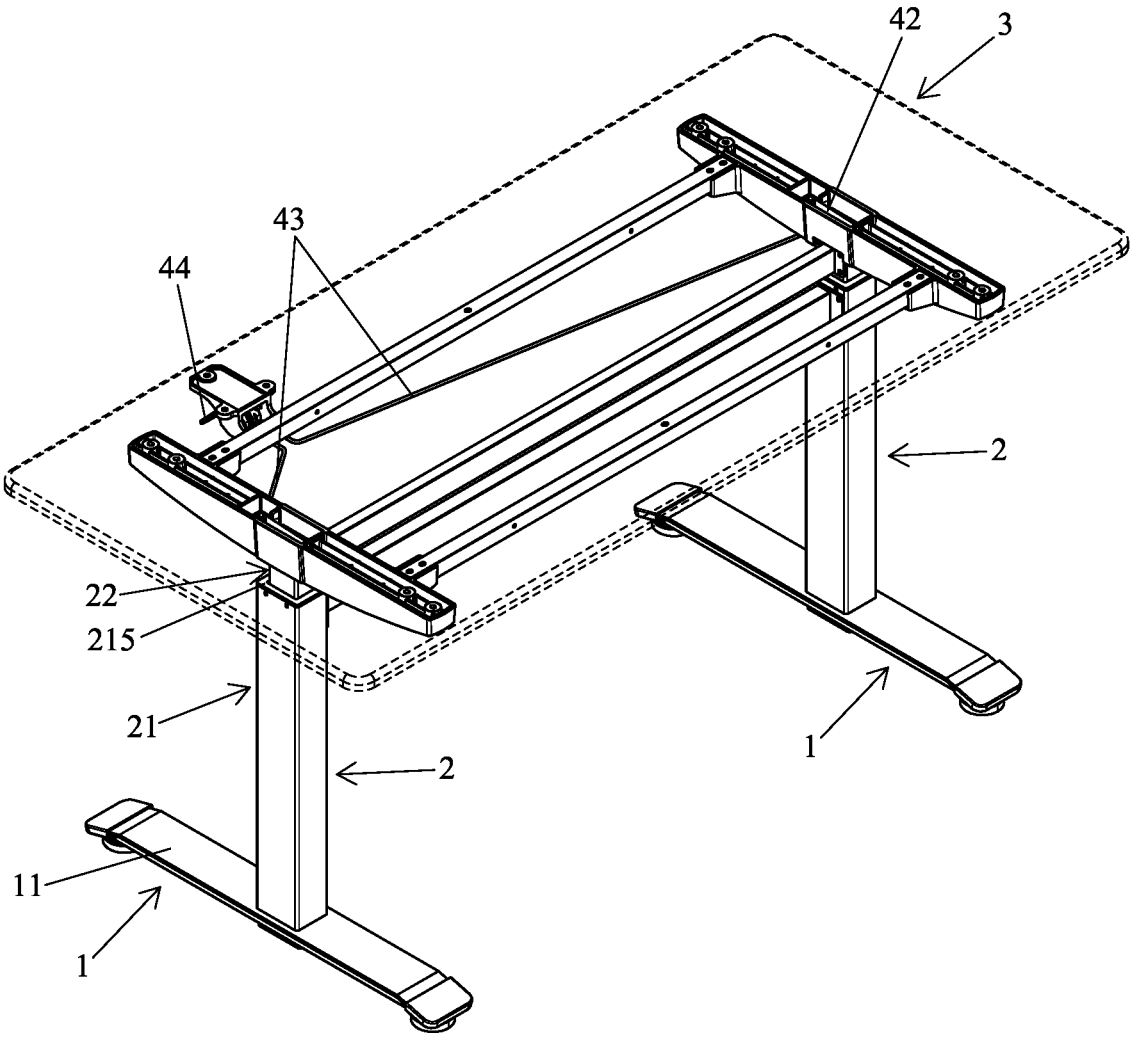
FIG. 3 is a perspective view of the desk frame elevation structure after assembly.
Figure 4:
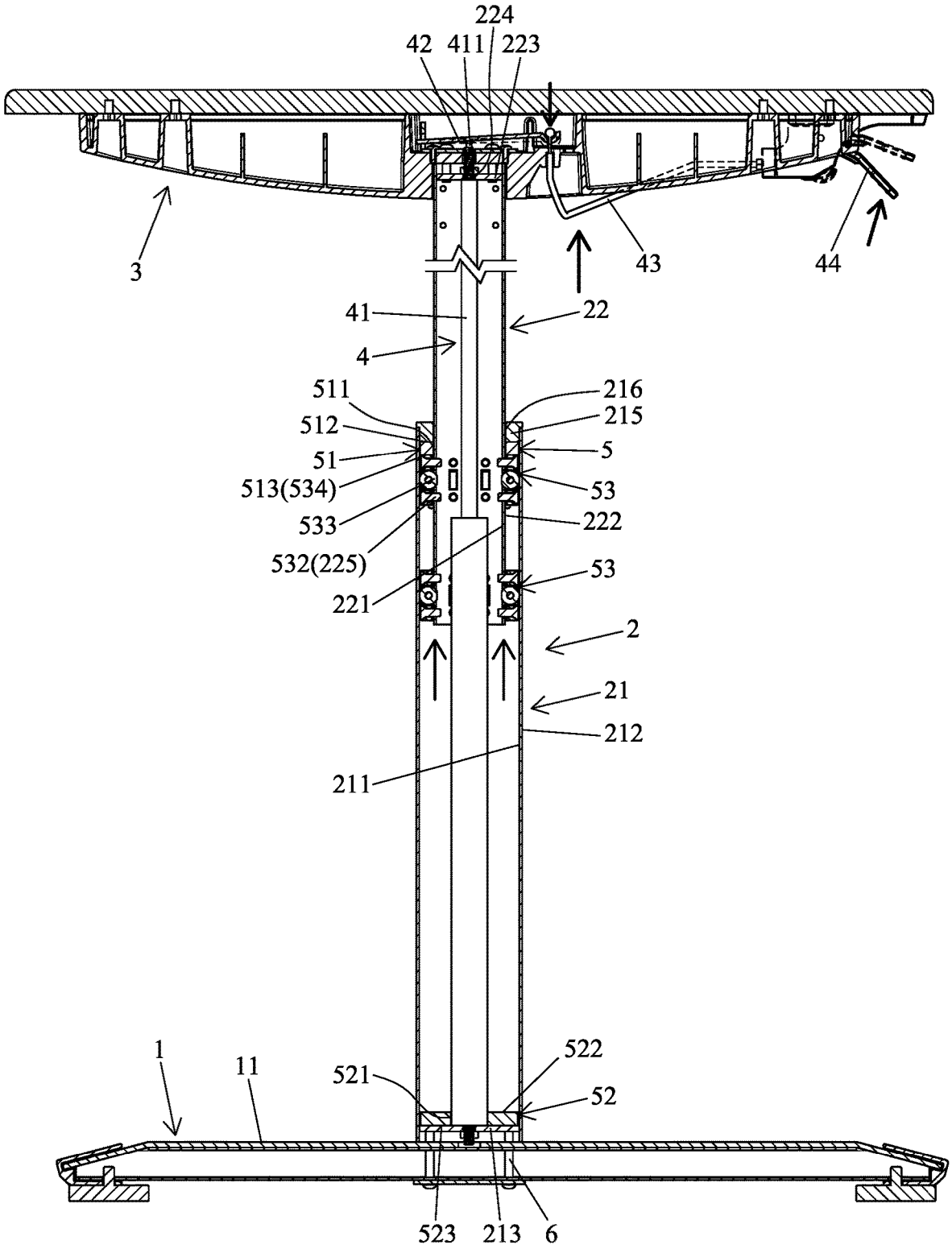
FIG. 4 is a cross sectional view of the desk frame elevation structure with a desk board in the highest position.

With reference to FIGS. 1-4 (FIGS. 1, 2, and 4 show a portion of the structure according to the present invention), a desk frame elevation structure of an embodiment according to the present invention comprises a base unit 1, an elevation unit 2, a desk board unit 3, a motion control unit 4, and a shock absorbing unit 5. The base unit 1 includes two bases 11 configured to be disposed on the ground. The two bases 11 are disposed parallel to each other. Each of the two bases 11 includes a central portion having connection holes 12.

The elevation unit 2 includes two elevation tubes each of which is comprised of an outer tube 21 and an inner tube 22. The two outer tubes 21 are hollow and have corresponding structures. Each outer tube 21 includes an inner periphery 211 and an outer periphery 212. Two bottom plates 213 are securely mounted to bottom ends of the two outer tubes 21. Each bottom plate 213 can be welded to the inner periphery 211 of a respective outer tube 21 and includes connection holes 214. Fasteners 6 extend through the connection holes 214 of each bottom plate 213 and the connection holes 12 of a respective base 11. Two first top plates 215 are securely mounted to top portions of the two outer tubes 21. Each of the two first top plates 215 can be welded to the inner periphery 211 of the respective outer tube 21 and includes a central portion having a first through-hole 216 through which the respective inner tube 22 extends.

The two inner tubes 22 have corresponding structures. Each inner tube 22 is telescopically received in the respective outer tube 21 and includes an inner periphery 221 and an outer periphery 222. Two second top plates 223 are securely mounted to top portions of the two inner tubes 22. Each of the two second top plates 223 can be welded to the inner periphery 221 of the respective inner tube 22 and includes a central portion having a second through-hole 224. Each inner tube 22 includes a lower portion having a plurality of assembling holes 225. Each of the plurality of assembling holes 225 extends from the inner periphery 221 through the inner periphery 222 of the respective inner tube 22.

The desk board unit 3 is disposed on top of the elevation unit 2 and is coupled to the inner tube 22 to move therewith.

The movement control unit 4 includes two telescopic rods 41, two control boards 42, two control cables 43, and a press button 44. Each of the two telescopic rods 41 has top and bottom ends. Each of the two telescopic rods 41 is a rod that can be controlled to extend automatically, such as a pneumatic rod, a hydraulic rod, or any telescopic rod. Each of the two telescopic rods 41 includes a control button 411 on a top end thereof. Each of the two telescopic rods 41 is disposed in the respective elevation tube comprised of the respective outer tube 21 and the respective inner tube 22. Each of the two telescopic rods 41 further includes a bottom end securely mounted to the bottom plate 213 of the respective outer tube 21. Each control button 411 extends through the second through-hole 224 of the second top plate 223 of the respective inner tube 22 to move jointly with the respective inner tube 22. Each of the two control boards 42 is disposed above a respective control button 411 and is operable to selectively press against or not press against the respective control button 411. Each of the two control cables 43 is connected to a respective one of the two control boards 42. The press button 44 is connected to the two control cables 43 and is disposed at a lower face of an outer side of the desk board unit 3 to permit easy control by an operator. The press button 44 can be operated to control the two control cables 43 to simultaneously actuate the two control boards 42, providing better control convenience.

For each elevation tube, the shock absorbing unit 5 includes an upper buffer pad 51, a lower buffer pad 52, and a roller unit 53. Each upper buffer pad 51 is made of rubber or other soft material. Each upper buffer pad 51 is disposed below the respective first top plate 215 of the respective outer tube 21 by adhering or other coupling mechanisms. Each upper buffer pad 51 includes a central portion having a third through-hole 511 through which the respective inner tube 22 extends. Each upper buffer pad 51 includes an upper face 512 and a lower face 513. The upper face 512 of each upper buffer pad 51 abuts the respective first top plate 215. Each lower buffer pad 52 is made of rubber or other soft material. Each lower buffer pad 51 is disposed above the respective bottom plate 213 of the respective outer tube 21 by adhering or other coupling mechanisms. Each lower buffer pad 52 includes a central portion having a through-hole 521 through which the respective telescopic rod 41 extends. Each lower buffer pad 51 includes an upper face 522 and a lower face 523. The lower face 523 of each lower buffer pad 52 abuts the respective bottom plate 213. Each roller unit 53 includes a plurality of roller seats 531 and a plurality of rollers 533. The plurality of roller seats 531 is made of non-metal material. Each of the plurality of roller seats 531 includes a peg 532. Each of the plurality of roller seats 531 is mounted to the outer periphery of the respective inner tube 22 by extending the peg 532 through a respective one of plurality of assembling holes 225. A top face of the uppermost one of the plurality of roller seats 531 forms an abutting edge 534 for abutting the lower face 513 of the respective upper buffer pad 51. Each of the plurality of rollers 533 is rotatably mounted on a respective one of the plurality of roller seats 531 and is capable of rolling on the inner periphery 211 of the respective outer tube 21.

The press button 44 can be pressed to actuate the two control cables 43 to simultaneously control the two control boards 42 to press against the two control buttons 411, thereby moving the two telescopic rods 41 synchronously. The desk board unit 3 can move upward or downward (when subjected to a force). After the desk board unit 3 is adjusted to a proper height, the press button 44 and the control boards 42 are released to retain the length of each telescopic rod 41 and the height of the desk top unit 3.

During the upward or downward movement of the desk board unit 3 according to the present invention, the rollers 533 of the roller units 53 roll on the inner periphery 211 of the respective outer tube 21, preventing friction noise between the respective inner tube 22 and the respective outer tube 21 while improving the motion stability. With reference to FIG. 4, when a user presses the press button 44 to make the two control boards 42 continuously press against the control buttons 411 for keeping the telescopic rods 41 in the extended state, the abutting edge 534 of the respective roller unit 43 abuts the lower face 513 of the respective upper buffer pad 51. This prevents large impact noise caused by the first top plate 215 of the respective outer tube 21 and the respective inner tube 22 moving rapidly upward. This further avoids larger shock of the desk board unit 3, improving the motion stability. The roller seats 531 are made of non-metal material, such as plastic, such that the impact sound between the abutting edge 534 formed by the uppermost roller seat 531 and the respective upper buffer pad 51 can be further reduced, providing a silence effect as well as improved motion quality effect.

Figure 5:
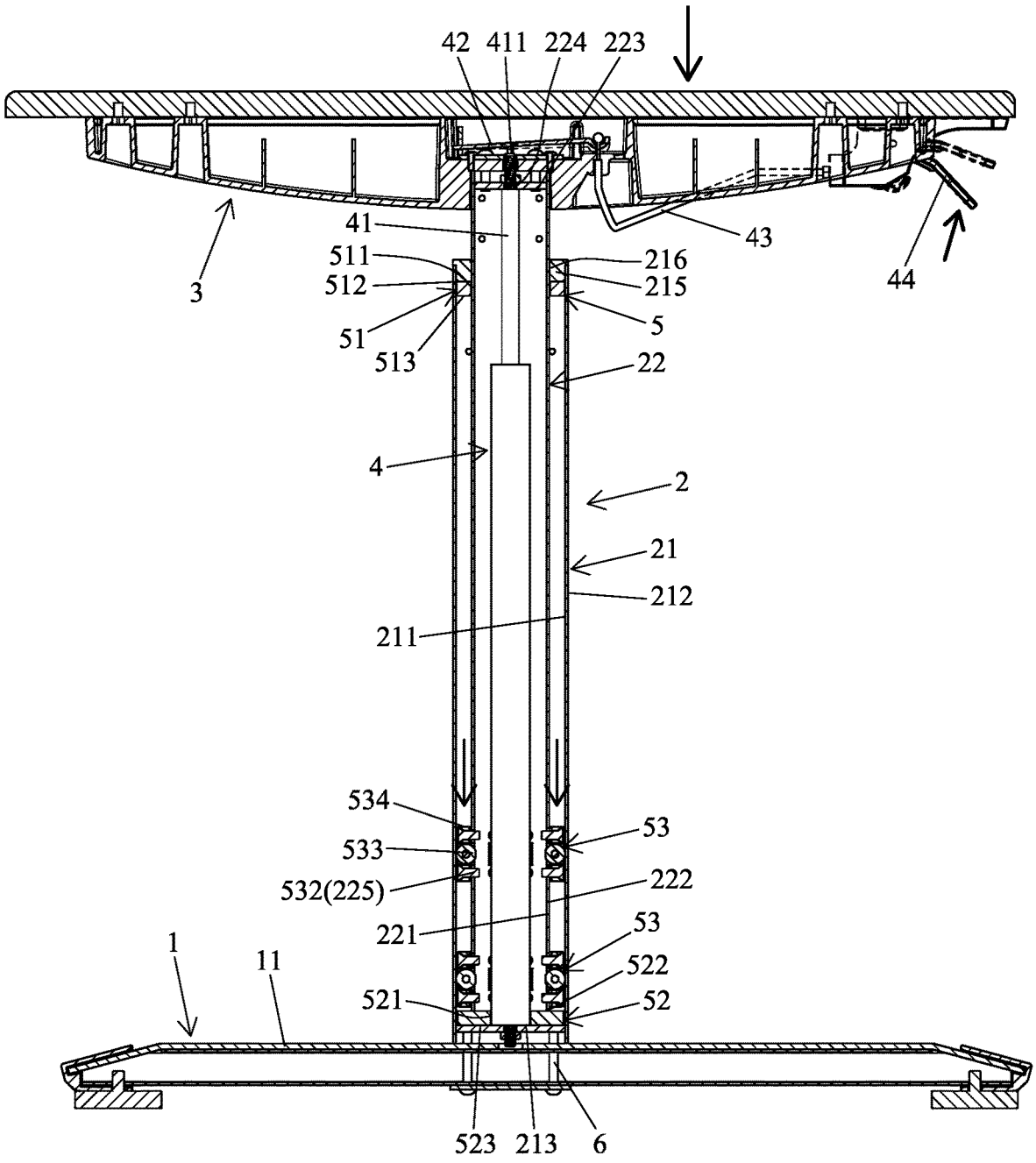
FIG. 5 is a cross sectional view of the desk frame elevation structure with the desk board in the lowest position.
Figure 6:
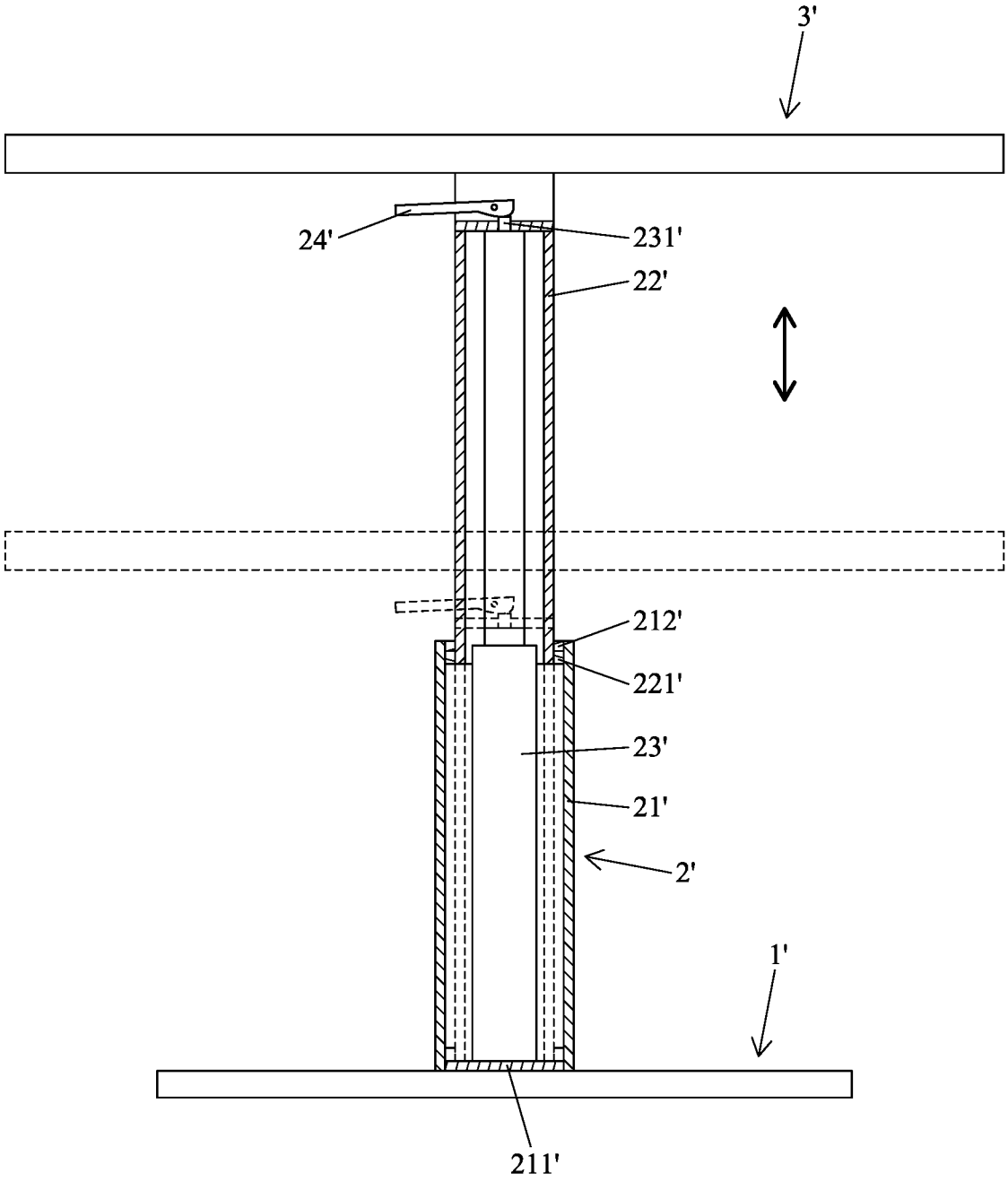
PRIOR ART F I G . 6
FIG. 6 is a cross sectional view of a conventional height-adjustable desk frame.

With reference to FIG. 5, when the press button 44 is pressed to actuate the control boards 42, which, in turn, press against the control buttons 411, a force can be applied to press the desk board unit 3 downward to thereby shorten the length of each telescopic rod 41 while lowering the respective inner tube 22. When the desk board unit 3 moves to the lowest position, the bottom end of each inner tube 22 abuts the upper face 522 of the respective lower buffer pad 52, avoiding larger impact noise between the bottom end of the respective inner tube 22 and the bottom plate 213 of the respective outer tube 21. Furthermore, the desk board unit 3 is prevented from larger shock to improve the motion stability and operational quality.

In view of the foregoing, the desk frame elevation structure according to the present invention can reduce the impact noise during vertical movement of the desk board unit 3 while improving the desk frame quality. The desk frame elevation structure according to the present invention can include only one base 11, only one elevation tube comprised of an outer tube 21 and an inner tube 22, only one telescopic rod 41, only one control board 42. Furthermore, in the elevation unit 2, the inner tube 22 can be coupled with the base 11, and the outer tube 22 can be coupled with the desk board unit 3.

Although specific embodiments have been illustrated and described, numerous modifications and variations are still possible without departing from the scope of the invention. The scope of the invention is limited by the accompanying claims.

The invention claimed is:

1. A desk frame elevation structure comprising:

a base unit including a base configured to be disposed on a ground;

an elevation unit including an elevation tube comprised of an outer tube and an inner tube, wherein the inner tube is received in the outer tube and is telescopic relative to the outer tube, wherein the outer tube includes a bottom end fixed to the base and includes an inner periphery and an outer periphery, wherein a bottom plate is securely mounted to the bottom end of the outer tube, wherein a first top plate is securely mounted to a top portion of the outer tube, wherein the first top plate includes a central portion having a first through-hole through which the inner tube extends, wherein the inner tube includes an inner periphery and an outer periphery, and wherein a second top plate is securely mounted to a top portion of the inner tube;

a desk board unit disposed on top of the elevation unit and coupled to the inner tube to move therewith;

a movement control unit including a telescopic rod having top and bottom ends and a control board, wherein a control button is disposed on the top end of the telescopic rod, wherein the telescopic rod is disposed in the elevation tube, wherein the top and bottom ends of the telescopic rod are coupled to the outer tube and the inner tube, respectively, wherein the control board is disposed in a position corresponding to the control button, and wherein the control board is operable to selectively press against or not press against the control button; and a shock absorbing unit including a roller unit, an upper buffer pad, and a lower buffer pad, wherein the roller unit includes a plurality of roller seats and a plurality of rollers, wherein the plurality of roller seats is disposed on the outer periphery of the inner tube, wherein a top face of an uppermost one of the plurality of roller seats forms an abutting edge, wherein each of the plurality of rollers is rotatably mounted on a respective one of the plurality of roller seats and is capable of rolling on the inner periphery of the outer tube, wherein the upper buffer pad is made of soft material and is disposed below the first top plate of the outer tube, wherein the upper buffer pad includes a central portion having a third through-hole through which the inner tube extends, wherein the upper buffer pad further includes an upper face and a lower face, wherein the upper face of the upper buffer pad abuts the first top plate, wherein the lower face of the upper buffer pad abuts the abutting edge of the inner tube when the desk top unit is in a highest position, wherein the lower buffer pad is made of soft material and is disposed above the bottom plate of the outer tube, wherein the lower buffer pad includes an upper face and a lower face, wherein the lower face of the lower buffer pad abuts the bottom plate, and wherein the upper face of the lower buffer pad abuts a bottom end of the inner tube when the desk top unit is in a lowest position.

2. The desk frame elevation structure as claimed in claim 1, wherein the second top plate of the inner tube includes a central portion having a second through-hole through which the control button of the telescopic rod extends.

3. The desk frame elevation structure as claimed in claim 1, wherein the lower buffer pad includes a central portion having a through-hole through which the telescopic rod extends, and wherein the bottom end of the telescopic rod extends through the through-hole of the lower buffer pad and is secured to the bottom plate of the outer tube.

4. The desk frame elevation structure as claimed in claim 1, wherein the inner tube includes a lower portion having a plurality of assembling holes, wherein each of the plurality of assembling holes extends from the inner periphery through the inner periphery of the inner tube, wherein each of the plurality of roller seats includes a peg, and wherein each of the plurality of roller seats is mounted to the outer periphery of the inner tube by extending the peg through a respective one of plurality of assembling holes.

5. The desk frame elevation structure as claimed in claim 1, wherein each of the plurality of roller seats is made of non-metal material.

6. The desk frame elevation structure as claimed in claim 1, wherein the movement control unit further includes a control cable and a press button, wherein the control cable is coupled to the control board for actuating the control board, and wherein the press button is connected to the control cable and is configured to control the control cable for actuating the control board.

7. The desk frame elevation structure as claimed in claim 1, wherein the base unit further includes another base, wherein the elevation unit further includes another elevation tube comprised of another outer tube and another inner tube telescopically received in the another outer tube, wherein the another outer tube includes a bottom end coupled to the another base, wherein the motion control unit further includes another telescopic rod and another control board, wherein the motion control unit further includes two control cables and a press button, wherein the another telescopic rod is disposed in the another elevation tube, wherein the another control board is disposed on a location corresponding to a control button of the another telescopic rod, wherein the two control cables are connected to the control board and the another control board, respectively, wherein the press button is connected to the two control cables and is configured to control the two control cables to simultaneously actuate the control board and the another control board, wherein the shock absorbing unit further includes another upper buffer pad and another lower buffer pad, and wherein the another upper buffer pad and the another lower buffer pad are received in the another elevation tube.

* * * * *